US006775938B2

(12) United States Patent
Lanci

(10) Patent No.: US 6,775,938 B2
(45) Date of Patent: Aug. 17, 2004

(54) CAROUSEL FRAME WITH SELECTIVE DISPLAY

(76) Inventor: Christopher Lanci, 44-16 23rd St., Syosset, NY (US) 11101

( * ) Notice: Subject to any disclaimer, the term of this patent is extended or adjusted under 35 U.S.C. 154(b) by 254 days.

(21) Appl. No.: 10/043,836

(22) Filed: Jan. 14, 2002

(65) Prior Publication Data

US 2003/0131509 A1 Jul. 17, 2003

(51) Int. Cl.[7] ..... G09F 11/02

(52) U.S. Cl. ..... 40/747; 40/473

(58) Field of Search ..... 40/717, 729, 730, 40/731, 747, 429, 430, 493; 84/94.1

(56) References Cited

U.S. PATENT DOCUMENTS 5,179,796 A * 1/1993 Gephart, Jr. ..... 40/473
5,203,743 A * 4/1993 Hou et al. ..... 472/7
5,276,271 A * 1/1994 Huang et al. ..... 84/94.1
5,986,189 A * 11/1999 Yang ..... 40/415

* cited by examiner

*Primary Examiner*—Cassandra H. Davis
(74) *Attorney, Agent, or Firm*—Charles E. Temko

(57) ABSTRACT

A carousel type display including a spring powered music box in which a horizontal rotating wheel-like element has selectively engageable recesses from which a plurality of display units are selectively suspended. The display units may include small picture frames, as well as comparably sized three dimensional ornaments which are provided with upwardly-extending pendants, spherically shaped terminals which allow rotation about a vertically oriented axis.

2 Claims, 2 Drawing Sheets

CAROUSEL FRAME WITH SELECTIVE DISPLAY

BACKGROUND OF THE INVENTION

This invention relates generally to the field of carousel type displays, typically including a rotating turntable supporting means for supporting a plurality of photographs and the like. Devices of this general type are known in the art, and the invention lies in specific constructional details which provide increased utility as well as an attractive appearance.

As typified in U.S. patent to Maris, U.S. Pat. No. 4,202,121, prior art construction commonly employs a rotating vertically-oriented shaft engageable with radially-oriented fins, each supporting a photograph or other planar display.

While such constructions are not without utility, they have, understandably, only a single function, i.e., the display of photographs.

In the case of children of relatively tender years, it is often desirable to use the same device as a source of amusement, for example, to lull a child to sleep, providing accompanying sound, as may be provided by a known type music box, the mechanism of which may be employed to power the turntable.

SUMMARY OF THE INVENTION

Briefly stated, the invention contemplates the provision of an improved carousel type display in which the above desiderata are provided. To this end, the device includes a relatively stationary base incorporating a music box mechanism, and supporting a vertical hollow shaft, the upper end of which supports a horizontally-oriented turntable. The shaft encloses a driven link interconnecting the music box mechanism with the turntable. The turntable includes a circular periphery having generally spherically-shaped sockets. The elements to be displayed each include a vertical extension having a terminal which engages a respective socket for selective retention. The display elements may be picture frames and/or three dimensional figures and the like.

BRIEF DESCRIPTION OF THE DRAWINGS

In the drawings, to which reference will be made in the specification.

DETAILED DESCRIPTION OF THE DISCLOSED EMBODIMENT

Figure 1:
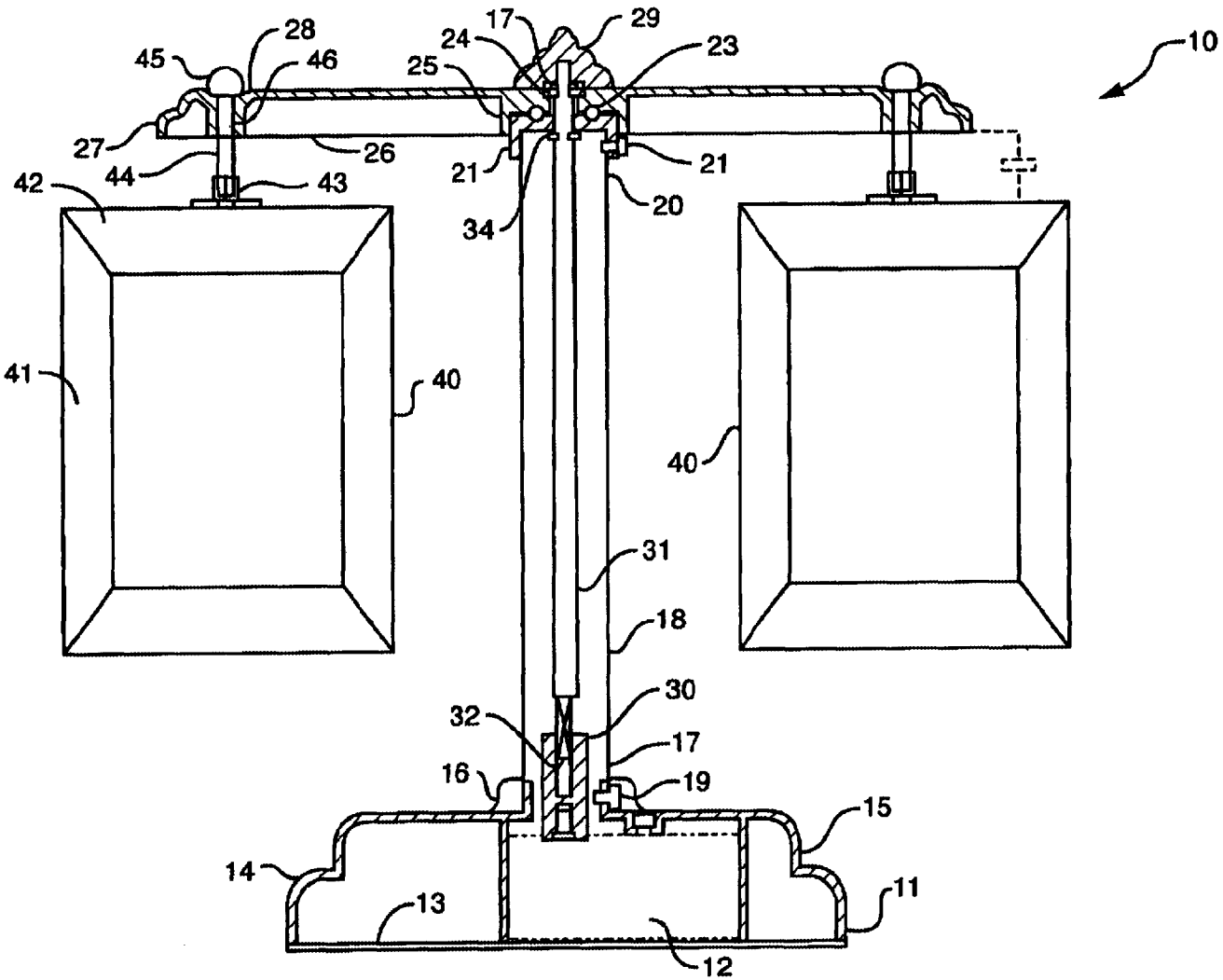
FIG. 1 is a sectional view of an embodiment of the invention showing picture frame display devices.

In accordance with the invention, the device, generally indicated by reference character 10, comprises a hollow base element 11 enclosing a known music box element 12. The base element includes a lower wall 13, integral side and upper walls 14 and 15, the latter forming a centrally positioned flange 16 which engages the lower end 17 of the hollow sleeve 18 to be retained by a set screw 19. An upper end 20 of the sleeve 18 supports a bearing base 21 with a set screw 22 which, in turn, provides a ball-bearing race 23, the bearings of which support a horizontally-oriented turntable 34. The turntable is generally circular in configuration, including a central portion 25 from which a plurality of spokes 26 radiate to interconnect with a peripheral member 27. The outer end of the spokes forms plural generally hemispherical sockets 28 which are open at one side to facilitate engagement and disengagement, as will more fully appear. A retaining cap 29 completes the assembly.

Disposed within the sleeve 18 is a motion transmitting bush 30 which interconnects with a spliced inner shaft 31 at a lower end 32 thereof. The upper end 33 is provided with a pin 34 to fix it to be turntable 24.

In one mode of employment, the turntable supports a plurality of individual frame elements 40, each including a peripheral member 41 having an upper horizontal member 42 with a mounting fixture 43 from which a short link or shaft 44 extends. A spherical terminal 45 corresponds to the respective socket 28, and engagement therewith is facilitated by passing the link 44 through a laterally-positioned opening 46.

Figure 2:
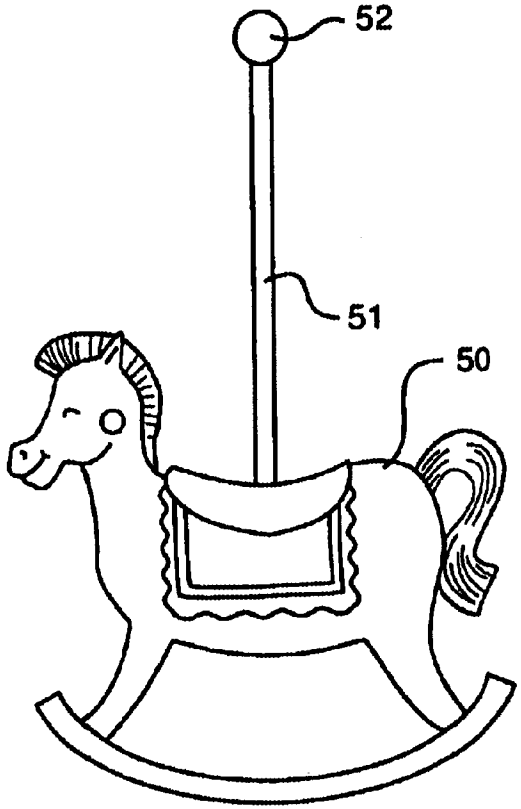
FIG. 2 is a side elevational view of a three dimensional ornament forming an alternative display element.

FIG. 2 illustrates a typical alternate display 50, in this case, a representation of a rocking horse which also includes an outwardly-extending link or shaft 51 and a spherical terminal 52 for engagement.

The device 10 may be used employing only picture frame elements 41 of the type shown in FIG. 1. Alternatively, the device may be used with elements 50, or a combination of both types. In the case of the latter, the surface of the upper terminal may include a flat surface (not shown) which engages a similar surface of the corresponding socket wherein the display is oriented so that its major area faces outwardly and is not subject to accidental rotation relative to the socket. The music box driving means is wound by rotating the terminal in a direction opposite to that which it normally rotates.

I wish it to be understood that I do not consider the invention to be limited to the precise details of structure disclosed in the specification, for obvious modifications will occur to those skilled in the art to which the invention pertains.

I claim:

1. A carousel display device including a relatively fixed base, and a relatively rotatable turntable supported by said base; means disposed within said base for driving said turntable; said turntable having a generally circular periphery, and a plurality of upwardly extending sockets arranged around said periphery; and a plurality of display elements, each display element having an upwardly extending link and an enlargement at an upper end of said link for selectively engaging a respective socket; said plurality of display elements including planar display frames and three dimensional objects; said upwardly extending sockets having laterally positioned openings to facilitate selective engagement of said display elements therewith.

2. A display device in accordance with claim 1, wherein said means for guiding said turntable includes a music box, said music box being wound by rotation of said turntable.

* * * * *